US006706325B2

(12) United States Patent
Spitsberg et al.

(10) Patent No.: US 6,706,325 B2
(45) Date of Patent: Mar. 16, 2004

(54) ARTICLE PROTECTED BY A THERMAL BARRIER COATING SYSTEM AND ITS FABRICATION

(75) Inventors: Irene Spitsberg, Loveland, OH (US); Robert William Bruce, Loveland, OH (US)

(73) Assignee: General Electric Company, Schenectady, NY (US)

( * ) Notice: Subject to any disclaimer, the term of this patent is extended or adjusted under 35 U.S.C. 154(b) by 200 days.

(21) Appl. No.: 09/944,909

(22) Filed: Aug. 31, 2001

(65) Prior Publication Data

US 2003/0044624 A1 Mar. 6, 2003

Related U.S. Application Data

(63) Continuation-in-part of application No. 09/569,912, filed on May 11, 2000, now Pat. No. 6,340,500, and a continuation-in-part of application No. 09/546,518, filed on Apr. 11, 2000, now Pat. No. 6,482,469.

(51) Int. Cl.[7] ..... C23C 14/08

(52) U.S. Cl. ..... 427/255.19; 427/255.395; 427/596; 427/355; 427/257; 427/367

(58) Field of Search ..... 427/250, 596, 427/355, 257, 367, 255.395, 255.19

(56) References Cited

U.S. PATENT DOCUMENTS 6,042,898 A * 3/2000 Burns et al. ..... 427/534
6,340,500 B1 * 1/2002 Spitsberg ..... 427/250
6,472,018 B1 * 10/2002 Warnes et al. ..... 427/250
6,482,469 B1 * 11/2002 Spitsberg et al. ..... 427/250

* cited by examiner

*Primary Examiner*—Timothy Meeks
(74) *Attorney, Agent, or Firm*—Gregory Garmong; Carmen Santa Maria; General Electric Company

(57) ABSTRACT

An article protected by a thermal barrier coating system is fabricated by providing an article substrate having a substrate surface, thereafter depositing a bond coat on the substrate surface, the bond coat having a bond coat surface, and thereafter processing the bond coat to flatten the bond coat surface. A thermal barrier coating is deposited overlying the bond coat surface. The thermal barrier coating is yttria-stabilized zirconia having a yttria content of from about 3 percent by weight to about 5 percent by weight of the yttria-stabilized zirconia.

17 Claims, 3 Drawing Sheets

ARTICLE PROTECTED BY A THERMAL BARRIER COATING SYSTEM AND ITS FABRICATION

This application is a continuation in part of application Ser. No. 09/546,518, filed Apr. 11, 2000, now U.S. Pat. No. 6,482,469, for which priority is claimed. This application is also a continuation in part of application Ser. No. 09/569,912, filed May 11, 2000, now U.S. Pat. No. 6,340,500, for which priority is claimed.

This invention relates to thermal barrier coating systems such as used to protect some components of gas turbine engines and, more particularly, to the bond coat surface and the composition of the thermal barrier coating.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high-temperature capabilities have been achieved through the formulation of nickel- and cobalt-base superalloys. Nonetheless, when used to form components of the turbine, combustor and augmentor sections of a gas turbine engine, such alloys alone are often susceptible to damage by oxidation and hot corrosion attack and may not retain adequate mechanical properties. For this reason, these components are often protected by an environmental and/or thermal-insulating coating, the latter of which is termed a thermal barrier coating (TBC) system. Ceramic materials and particularly yttria-stabilized zirconia (YSZ) are widely used as a thermal barrier coating (TBC), or topcoat, of TBC systems used on gas turbine engine components. The TBC employed in the highest-temperature regions of gas turbine engines is typically deposited by electron beam physical vapor deposition (EBPVD) techniques that yield a columnar grain structure that is able to expand and contract without causing damaging stresses that lead to spallation.

To be effective, TBC systems must have low thermal conductivity, strongly adhere to the article, and remain adherent throughout many heating and cooling cycles. The latter requirement is particularly demanding due to the different coefficients of thermal expansion between ceramic topcoat materials and the superalloy substrates they protect. To promote adhesion and extend the service life of a TBC system, an oxidation-resistant bond coat is usually employed. Bond coats are typically in the form of overlay coatings such as MCrAlX (where M is iron, cobalt, and/or nickel, and X is yttrium or another rare earth element), or diffusion aluminide coatings. A notable example of a diffusion aluminide bond coat contains platinum aluminide (NiPtAl) intermetallic. When a bond coat is applied, a zone of interdiffusion forms between the substrate and the bond coat. This zone is typically referred to as a diffusion zone. The diffusion zone beneath an overlay bond coat is typically much thinner than the diffusion zone beneath a diffusion bond coat.

During the deposition of the ceramic TBC and subsequent exposures to high temperatures, such as during engine service, bond coats of the type described above oxidize to form a tightly adherent alumina (aluminum oxide or $Al_2O_3$) layer or scale that protects the underlying structure from catastrophic oxidation and also adheres the TBC to the bond coat. The service life of a TBC system is typically limited by spallation at or near the interfaces of the alumina scale with the bond coat or with the TBC. The spallation is induced by thermal fatigue as the article substrate and the thermal barrier coating system are repeatedly heated and cooled during engine service.

There is a need for an understanding of the specific mechanisms that lead to the thermal fatigue failure of the protective system, and for structures that extend the life of the coating before the incidence of such failure. The present invention fulfills this need, and further provides related advantages.

BRIEF SUMMARY OF THE INVENTION

The present invention provides an approach for fabricating an article protected by a thermal barrier coating system, and articles protected by the thermal barrier coating system. The life of the thermal barrier coating system is extended under conditions of thermal fatigue by delaying the onset of the alumina scale interface failure mode and also reducing the delamination of the thermal barrier coating.

A method of fabricating an article protected by a thermal barrier coating system comprises the steps of providing an article substrate having a substrate surface, and thereafter producing a flattened bond coat on the substrate surface by depositing a bond coat on the substrate surface, the bond coat having a bond coat surface, and processing the bond coat to achieve a flattened bond coat surface. A thermal barrier coating is deposited overlying the bond coat surface. The thermal barrier coating comprises yttria-stabilized zirconia having a yttria content of from about 3 percent by weight to about less than 6 percent by weight of the yttria-stabilized zirconia, preferably from about 3.8 to about 4.2 percent by weight of the yttria-stabilized zirconia. The thermal barrier coating is preferably deposited by a physical vapor deposition technique such as electron beam physical vapor deposition, although other techniques may be used.

The article substrate preferably is a nickel-base superalloy, and most preferably is a component of a gas turbine engine. The bond coat may be a diffusion aluminide bond coat such as a platinum aluminide bond coat, or it may be an overlay bond coat.

The protective coating may be flattened without removing material from the protective-coating surface, as by peening the protective coating. Alternatively, the protective coating may be flattened by removing material from the protective-coating surface, as by polishing the protective coating. Desirably, the step of processing the protective coating produces a protective coating surface wherein an average grain boundary displacement height of the protective coating is less than about 3 micrometers, more preferably less than about 1 micrometer, even more preferably less than about 0.5 micrometer, and most preferably substantially zero, over at least about 40 percent of the surface area of the protective coating but more preferably over the entire surface area of the protective coating. Where the processing is accomplished by polishing, the average grain boundary displacement height may be substantially zero in the polished areas, where the polishing is to a mirror finish. In most cases, the step of processing the protective coating is performed after the step of depositing the protective coating is complete. In some cases, however, the steps of depositing the protective coating and processing the protective coating are performed concurrently. Additionally, it is preferred that at least about 40 percent, and more preferably all, of the surface of the protective coating is flattened to have a grain displacement height of less than about 3 micrometers, more preferably less than about 1 micrometer, even more preferably less than about 0.5 micrometer, and most preferably zero.

An article protected by a thermal barrier coating system comprises an article substrate having a substrate surface, a bond coat on the substrate surface, the bond coat having a bond coat surface with a grain boundary displacement height of less than about 3 micrometers, more preferably less than about 1 micrometer, even more preferably less than about 0.5 micrometer, and most preferably substantially zero, over at least about 40 percent, and preferably over 100 percent, of the grain boundaries. A thermal barrier coating overlies and contacts the bond coat surface. The thermal barrier coating comprises yttria-stabilized zirconia having a yttria content of from about 3 percent by weight to about less than 6 percent by weight of the yttria-stabilized zirconia. Features discussed above in relation to the fabrication method may be used in conjunction with the article as well.

The present approach addresses two major mechanisms of thermal fatigue failure in thermal barrier coating systems. The flattening of the bond coat surface reduces the tendency of the bond coat to form the convolutions that lead to spalling of the alumina scale that forms on the bond coat surface. The selection of the yttria-stabilized zirconia with low yttrium content reduces the tendency of the thermal barrier coating to fail and to debond from the alumina as a result of differential thermal strains and stresses during thermal fatigue cycling, and also reduces the differential thermal strains and stresses on the alumina/bond coat interface. As a result, failure of the thermal barrier coating system during thermal fatigue is delayed, improving its life.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
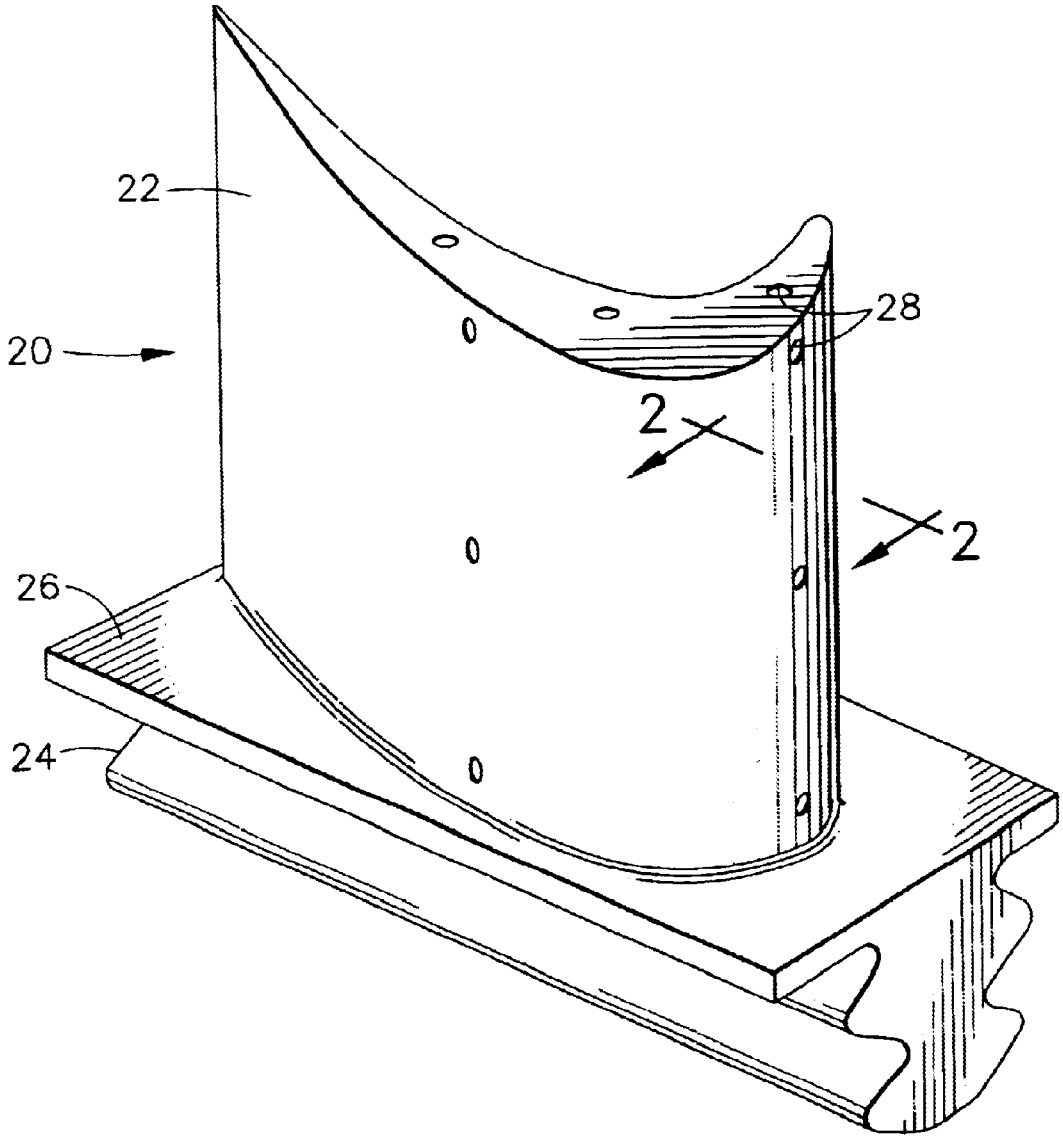
FIG. 1 is a perspective view of a turbine blade.

FIG. 1 depicts a component article of a gas turbine engine such as a turbine blade or turbine vane, and in this illustration a turbine blade 20. The turbine blade 20 is formed of any operable material, but is preferably a nickel-base superalloy. The turbine blade 20 includes an airfoil section 22 against which the flow of hot exhaust gas is directed. (The turbine vane or nozzle has a similar appearance in respect to the pertinent airfoil section, but typically includes other end structure to support the airfoil.) The turbine blade 20 is mounted to a turbine disk (not shown) by a dovetail 24 which extends downwardly from the airfoil 22 and engages a slot on the turbine disk. A platform 26 extends longitudinally outwardly from the area where the airfoil 22 is joined to the dovetail 24. A number of internal passages extend through the interior of the airfoil 22, ending in openings 28 in the surface of the airfoil 22. During service, a flow of cooling air is directed through the internal passages to reduce the temperature of the airfoil 22.

Figure 2:
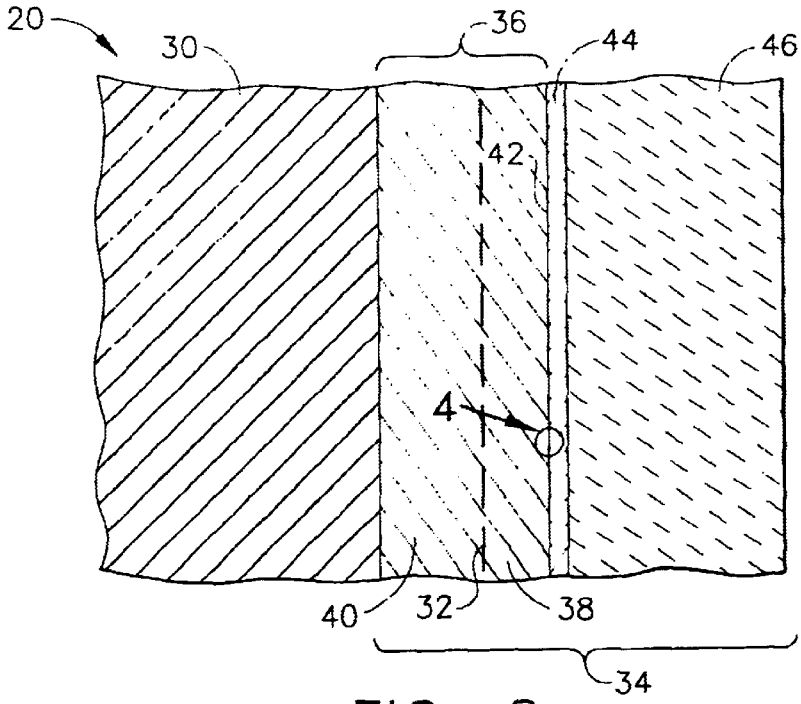
FIG. 2 is an enlarged schematic sectional view through the turbine blade of FIG. 1, taken on lines 2—2.

FIG. 2 is a schematic sectional view, not drawn to scale, through a portion of the turbine blade 20, here the airfoil section 22. The turbine blade 20 has a body that serves as a substrate 30 with a surface 32. Overlying and contacting the surface 32 of the substrate 30, and also extending downwardly into the substrate 30, is a thermal barrier coating system 34 including a protective coating, which in this case is termed a bond coat 36. The bond coat 36 includes a deposited layer 38 and a diffusion zone 40 that is the result of interdiffusion of material from the deposited layer 38 with material from the substrate 30. The process that deposits the deposited layer 38 onto the surface 32 of the substrate 30 is performed at elevated temperature, so that during deposition the material of the deposited layer 38 interdiffuses into and with the material of the substrate 30, forming the diffusion zone 40. The diffusion zone 40, indicated by a dashed line in FIG. 2, is a part of the bond coat 36 but extends downward into the substrate 30.

The bond coat 36 has an outwardly facing bond coat surface 42 remote from the surface 32 of the substrate 30. An alumina (aluminum oxide, or $Al_2O_3$) scale 44 forms at this bond coat surface 42 by oxidation of the aluminum in the bond coat 36 at the bond coat surface 40. A ceramic thermal barrier coating 46 overlies and contacts the bond coat surface 42 and the alumina scale 44 thereon.

Figure 3:
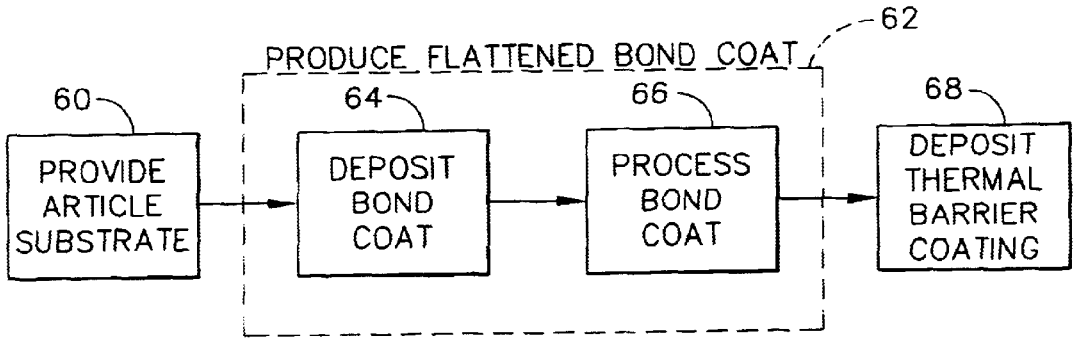
FIG. 3 is a block flow diagram of an approach for preparing a coated gas turbine airfoil.

FIG. 3 is a block flow diagram of a preferred approach for fabricating an article. An article and thence the substrate 30 are provided, numeral 60. The article is preferably a component of a gas turbine engine such as a gas turbine blade 20 or vane (or "nozzle", as the vane is sometimes called), see FIG. 1. The article is a single crystal article, a preferentially oriented polycrystal, or a randomly oriented polycrystal. The article is most preferably made of a nickel-base superalloy. As used herein, "nickel-base" means that the composition has more nickel present than any other element. The nickel-base superalloys are typically of a composition that is strengthened by the precipitation of gamma-prime phase. The preferred nickel-base alloy has a composition, in weight percent, of from about 4 to about 20 percent cobalt, from about 1 to about 10 percent chromium, from about 5 to about 7 percent aluminum, from 0 to about 2 percent molybdenum, from about 3 to about 8 percent tungsten, from about 4 to about 12 percent tantalum, from 0 to about 2 percent titanium, from 0 to about 8 percent rhenium, from 0 to about 6 percent ruthenium, from 0 to about 1 percent niobium, from 0 to about 0.1 percent carbon, from 0 to about 0.01 percent boron, from 0 to about 0.1 percent yttrium, from 0 to about 1.5 percent hafnium, balance nickel and incidental impurities.

A most preferred alloy composition is Rene' N5, which has a nominal composition in weight percent of about 7.5 percent cobalt, about 7 percent chromium, about 6.2 percent aluminum, about 6.5 percent tantalum, about 5 percent tungsten, about 1.5 percent molybdenum, about 3 percent rhenium, about 0.05 percent carbon, about 0.004 percent boron, about 0.15 percent hafnium, up to about 0.01 percent yttrium, balance nickel and incidental impurities. Other operable superalloys include, for example, Rene' N6, which has a nominal composition in weight percent of about 12.5 percent cobalt, about 4.2 percent chromium, about 1.4 percent molybdenum, about 5.75 percent tungsten, about 5.4 percent rhenium, about 7.2 percent tantalum, about 5.75 percent aluminum, about 0.15 percent hafnium, about 0.05 percent carbon, about 0.004 percent boron, about 0.01 percent yttrium, balance nickel and incidental impurities; Rene 142, which has a nominal composition, in weight percent, of about 12 percent cobalt, about 6.8 percent chromium, about 1.5 percent molybdenum, about 4.9 percent tungsten, about 6.4 percent tantalum, about 6.2 percent aluminum, about 2.8 percent rhenium, about 1.5 percent hafnium, about 0.1 percent carbon, about 0.015 percent boron, balance nickel and incidental impurities; CMSX-4, which has a nominal composition in weight percent of about 9.60 percent cobalt, about 6.6 percent chromium, about 0.60 percent molybdenum, about 6.4 percent tungsten, about 3.0 percent rhenium, about 6.5 percent tantalum, about 5.6 percent aluminum, about 1.0 percent titanium, about 0.10 percent hafnium, balance nickel and incidental impurities; CMSX-10, which has a nominal composition in weight percent of about 7.00 percent cobalt, about 2.65 percent chromium, about 0.60 percent molybdenum, about 6.40 percent tungsten, about 5.50 percent rhenium, about 7.5 percent tantalum, about 5.80 percent aluminum, about 0.80 percent titanium, about 0.06 percent hafnium, about 0.4 percent niobium, balance nickel and incidental impurities; PWA1480, which has a nominal composition in weight percent of about 5.00 percent cobalt, about 10.0 percent chromium, about 4.00 percent tungsten, about 12.0 percent tantalum, about 5.00 percent aluminum, about 1.5 percent titanium, balance nickel and incidental impurities; PWA1484, which has a nominal composition in weight percent of about 10.00 percent cobalt, about 5.00 percent chromium, about 2.00 percent molybdenum, about 6.00 percent tungsten, about 3.00 percent rhenium, about 8.70 percent tantalum, about 5.60 percent aluminum, about 0.10 percent hafnium, balance nickel and incidental impurities; and MX-4, which has a nominal composition as set forth in U.S. Pat. No. 5,482,789, in weight percent, of from about 0.4 to about 6.5 percent ruthenium, from about 4.5 to about 5.75 percent rhenium, from about 5.8 to about 10.7 percent tantalum, from about 4.25 to about 17.0 percent cobalt, from 0 to about 0.05 percent hafnium, from 0 to about 0.06 percent carbon, from 0 to about 0.01 percent boron, from 0 to about 0.02 percent yttrium, from about 0.9 to about 2.0 percent molybdenum, from about 1.25 to about 6.0 percent chromium, from 0 to about 1.0 percent niobium, from about 5.0 to about 6.6 percent aluminum, from 0 to about 1.0 percent titanium, from about 3.0 to about 7.5 percent tungsten, and wherein the sum of molybdenum plus chromium plus niobium is from about 2.15 to about 9.0 percent, and wherein the sum of aluminum plus titanium plus tungsten is from about 8.0 to about 15.1 percent, balance nickel and incidental impurities. The use of the present invention is not limited to these preferred alloys, and has broader applicability.

A flattened bond coat 36 is produced on the surface 32 of the substrate 30, numeral 62. As part of this step 62, the bond coat 36 is applied, numeral 64. The bond coat is preferably a diffusion aluminide bond coat, produced by depositing an aluminum-containing layer onto the substrate 30 and interdiffusing the aluminum-containing layer with the substrate 30 to produce the deposited layer 38 and the diffusion zone 40 shown in FIG. 2. The bond coat may be a simple diffusion aluminide, or it may be a more-complex diffusion aluminide wherein another layer, preferably platinum, is first deposited upon the surface 32, and the aluminum-containing layer is deposited over the first-deposited layer. In either case, the aluminum-containing layer may be doped with other elements that modify the bond coat. The basic application procedures for these various types of bond coats are known in the art, except for the modifications to the processing and structure discussed herein.

Because the platinum-aluminide diffusion aluminide is preferred, its deposition will be described in more detail. A platinum-containing layer is first deposited onto the surface 32 of the substrate 30. The platinum-containing layer is preferably deposited by electrodeposition. For the preferred platinum deposition, the deposition is accomplished by placing a platinum-containing solution into a deposition tank and depositing platinum from the solution onto the surface 32 of the substrate 30. An operable platinum-containing aqueous solution is $Pt(NH_3)_4HPO_4$ having a concentration of about 4–20 grams per liter of platinum, and the voltage/current source is operated at about ½–10 amperes per square foot of facing article surface. The platinum first coating layer, which is preferably from about 1 to about 6 micrometers thick and most preferably about 5 micrometers thick, is deposited in 1–4 hours at a temperature of 190–200° F.

A layer comprising aluminum and any modifying elements is deposited over the platinum-containing layer by any operable approach, with chemical vapor deposition preferred. In that approach, a hydrogen halide activator gas, such as hydrogen chloride, is contacted with aluminum metal or an aluminum alloy to form the corresponding aluminum halide gas. Halides of any modifying elements are formed by the same technique. The aluminum halide (or mixture of aluminum halide and halide of the modifying element, if any) contacts the platinum-containing layer that overlies the substrate 30, depositing the aluminum thereon. The deposition occurs at elevated temperature such as from about 1825° F. to about 1975° F. so that the deposited aluminum atoms interdiffuse into the substrate 30 during a 4 to 20 hour cycle.

The protective coating 36 is thereafter processed to achieve a flattened protective-coating surface 42, numeral 66. The flattening may be achieved either with an approach that does not remove a substantial amount of metal from the surface 42 of the protective coating 36, or with an approach that intentionally removes metal from the surface 42 of the protective coating 36. Both have been demonstrated as operable.

Figure 4:
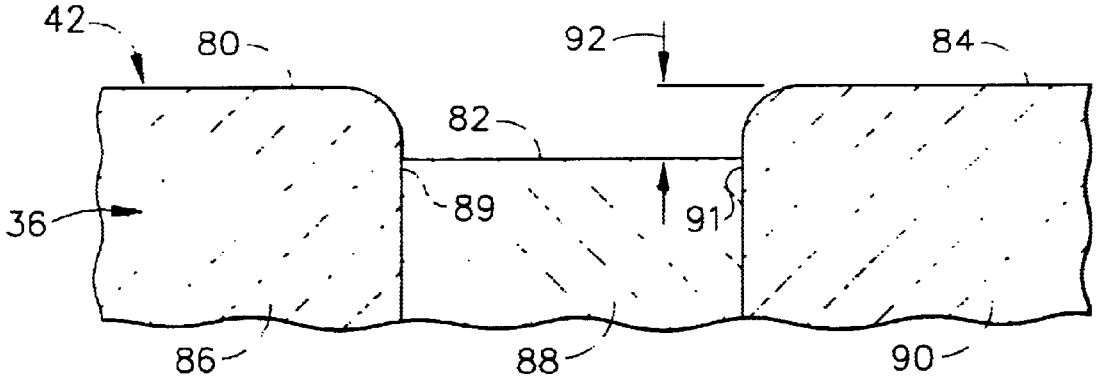
FIG. 4 is a schematic detail of the surface of the bond coat, taken in region 4 of FIG. 2 but without the alumina scale present, prior to flattening of the surface.
Figure 5:
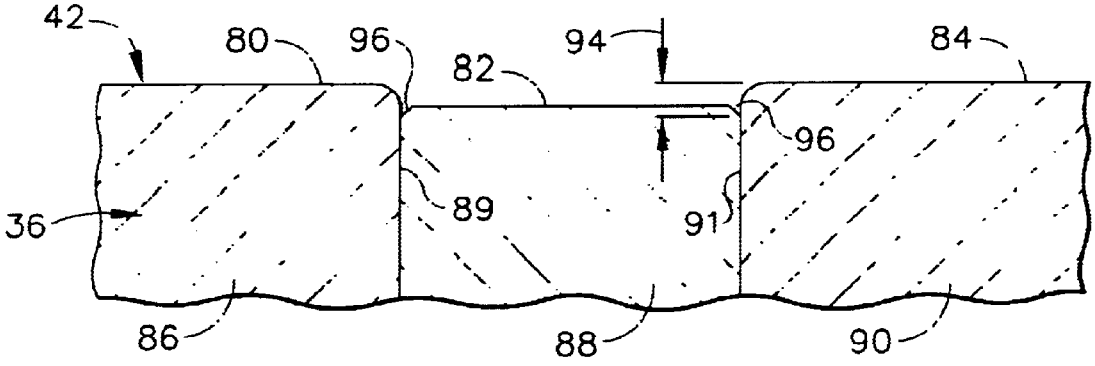
FIG. 5 is a schematic detail of the surface of the bond coat similar to that of FIG. 4, but after flattening of the surface.

FIGS. 4–5 illustrate the meaning of "flattening" and "polishing" as used herein. The surface 42 of the protective coating 36 is not perfectly flat when viewed at high magnification in a sectioning plane perpendicular to the surface 42. Instead, as seen in FIG. 4, there is a local maximum vertical displacement (i.e., perpendicular to the surface 42) between the points on the surfaces of adjacent pairs of grains at the grain boundaries. For example, in FIG. 4 there is a vertical displacement between respective surfaces 80 and 82 of neighboring grains 86 and 88 at a grain boundary 89, and another vertical displacement between respective surfaces 82 and 84 of neighboring grains 88 and 90 at a grain boundary 91. This vertical displacement is an initial grain boundary displacement height 92. The initial average magnitude of the grain boundary displacement height 92 for a diffusion aluminide protective coating is typically on the order of about 5 micrometers. This magnitude of the grain boundary displacement height leads to a failure mechanism of the alumina scale 44 during subsequent service termed ratcheting that produces convolutions in the alumina scale 44 in the neighborhood of the grain boundaries 89 and 91.

According to the present approach, the magnitude of the initial grain boundary displacement height 92 is reduced to a maximum final grain boundary displacement height 94 as illustrated in FIG. 5 by the processing 66. There may be slight grooves 96 at the intersections of the grain boundaries 89 and 91 with the surface 42. The final grain boundary displacement height 94 is measured to the bottoms of the grooves 96, where present, or to the grain surface 82 where no grooves 96 are present. Where the surfaces 82 and 84 are at the same height and there is a groove 96 present, the grain boundary displacement height 94 is measured from the bottom of the groove 96 to either the surface 82 or the surface 84. Where the surfaces 82 and 84 are at the same height and there are no grooves 96 present, the grain boundary displacement height 94 is zero. The average final grain boundary displacement height 94 is less than about 3 micrometers, more preferably less than about 1 micrometer, more preferably less than about 0.5 micrometer, and most preferably substantially zero, to suppress the incidence of the convolution/ratcheting failure mechanism. Achieving these grain boundary displacement heights 94 over 40 percent or more of the grain boundaries results in improvement in the service life of the protective coating, although it is preferred that the indicated grain boundary displacement heights 94 are achieved over all of the grain boundaries. It is further preferred that at least about 40 percent, and more preferably all, of the surface of the protective coating has a grain displacement height of less than about 3 micrometers, more preferably less than about 1 micrometer, more preferably less than about 0.5 micrometer to suppress failure initiating at locations away from the grain boundaries.

The grain boundary displacement height is determined in an enlarged sectional view like that of FIG. 5, taken in a plane perpendicular to the protective-coating surface 42 and measured across the locations where grain boundaries in the protective coating 36 intersect the protective-coating surface 42. This reduction in the average grain boundary displacement height reduces the severity of, and extends the time of the onset of, the thermal cycling deformation convolution mechanism that leads to failure of the alumina scale 44.

The processing 66 (i.e., flattening) without removal of metal may be accomplished by peening (sometimes termed "shot peening"). In this technique, the surface 42 of the protective coating 36 is impacted with a flow of a shot made of a material that is hard relative to the protective coating 36, so that the protective coating 36 is deformed. The peening has the effect of mechanically smashing down the high points of the surface 42 of the protective coating 36, so that the surface is flattened. The preferred peening approach is to peen the surface 42 with zirconia or stainless steel shot with a peening intensity of from about 6A to about 12A for a typical aluminum coating, but depending upon the hardness of the protective coating 36. If the peening intensity is lower than this range, there is insufficient plastic deformation to achieve the flattening. If the peening intensity is higher than this range, there may be cracking or other damage to the protective coating 36 or to the underlying substrate 30. Optionally, the peened article may be heat treated after peening, to either stress relieve or recrystallize the protective coating 36. A stress-relief heat treatment may be achieved at 1925° F. in two hours. A recrystallize heat treatment may be achieved at 2050° F. in two hours.

The processing 66 with removal of metal may be accomplished by polishing. In this technique, the surface is polished so that a small amount of metal, such as about 2 micrometers thickness or more, is removed from the surface 42 of the protective coating 36. The metal is not removed uniformly, but instead is preferentially removed from the grain boundary ridge and other defect regions that extend higher than their neighboring grains. The result is that the average magnitude of the final grain boundary displacement height 94 is reduced. Polishing may be accomplished by any operable technique wherein the difference between the high points and the low points is reduced. The preferred approach is mechanical polishing, but other types of polishing such as electrochemical polishing may be used where operable. To demonstrate the operability of the process, specimens of nickel-base superalloy substrates with platinum aluminide protective coatings 36 were vibratory polished using a Syntron machine with a 400 gram load and a 1 rpm rotation speed. The result is a highly polished surface that may be mirror-like depending upon the extent of the polishing. In commercial practice with irregularly shaped articles, polishing may be accomplished, for example, by tumbling, vibrolapping, or electropolishing.

After the processing 66, the bond coat surface 42 is oxidized to form the alumina scale 44, either as a separate step or as part of the next step 68 or during service.

The thermal barrier coating 46 is deposited overlying the flattened bond coat surface 42 and any alumina scale 44 that has formed thereon, numeral 68. The ceramic thermal barrier coating 46 is preferably from about 0.003 to about 0.010 inch thick, most preferably about 0.005 inch thick. The ceramic thermal barrier coating 46 may be deposited by any operable technique, such as electron beam physical vapor deposition or plasma spray.

The ceramic thermal barrier coating 46 is yttria-stabilized zirconia (YSZ), which is zirconium oxide containing yttrium oxide that stabilizes the phase structure of the zirconium oxide. In the past, it has been known to use YSZ with from about 2 to about 12 weight percent of yttrium oxide. The prevailing industrial practice is to use YSZ with about 7 weight percent yttrium oxide (termed 7YSZ herein).

The present invention requires the use of YSZ having a yttria content of from about 3 percent by weight to about less than 6 percent by weight of the yttria-stabilized zirconia. More preferably, the YSZ has a yttria content of from about 3.8 percent by weight to about 4.2 percent by weight of the yttria-stabilized zirconia, or about 4 weight percent yttria (termed 4YSZ herein). The effective density of 4YSZ is about 10 percent less than that of 7YSZ, due to a lower fraction of sintered columnar grain boundaries in the 4YSZ. The 4YSZ is a more open, more loosely bound array of columnar grains than is the 7YSZ. This altered microstructure does not adversely affect the thermal insulating properties of the YSZ, because the columnar grains of the YSZ extend generally perpendicular to the bond coat surface 42. The lower fraction of sintered grain boundaries increases the in-plane mechanical compliance of the 4YSZ as compared with the 7YSZ, so that during thermal fatigue cycling there is less stress placed on the alumina scale 44 and its interfaces with the bond coat 36 and the thermal barrier coating 46. If the YSZ of the present invention has less than about 3 percent by weight of yttria, there is insufficient yttria to stabilize the zirconia, and the formation of an excessive amount of monoclinic zirconia leads to premature failure of the thermal barrier coating. If the YSZ of the present invention has more than about 6 percent by weight of yttria, the density of the YSZ becomes too high to realize the advantages otherwise achieved.

To verify the effect of the altered chemistry of the YSZ, comparative studies were performed in which otherwise-identical specimens having 7YSZ and 4YSZ thermal barrier coatings 46 were furnace cycle tested (FCT) to 2075° F. with 1 hour cycle times. The number of cycles until failure was recorded. In a first series, with the YSZ in each case deposited at a lower temperature, the 7YSZ exhibited FCT lives of 505+/−23 cycles. Separate batches of the 4 YSZ exhibited FCT lives of 560+/−23 cycles, 615+/−89 cycles, and 570+/−90 cycles. The 4YSZ had about a 15 percent life increase over the 7YSZ. In a second series, with the YSZ in each case deposited at a higher temperature, the 7YSZ exhibited FCT lives of 450+/−38 cycles and 400+/−54 cycles. The 4YSZ exhibited an FCT life of 530+/−35 cycles. The FCT lives were generally lower as a result of the sintering of the YSZ boundaries in the higher temperature deposition process, but the 4YSZ had about a 30 percent life increase over the 7YSZ.

The flattening and the use of the YSZ with from about 3 percent by weight to about 5 percent by weight of yttria must be employed together in the present invention. The flattening of the protective-coating surface 42 (step 66) reduces the tendency of the protective coating 36 to form the convolutions by a ratcheting mechanism that lead to spalling of the alumina that forms on the protective-coating surface 42. The selection of the yttria-stabilized zirconia with low yttrium content reduces the tendency of the thermal barrier coating to fail and to debond from the alumina as a result of differential thermal strains and stresses during thermal fatigue cycling, and also reduces the differential thermal strains and stresses on the alumina/bond coat interface. Thus, both mechanisms of failure are addressed and their tendency to cause early failure is suppressed. Suppressing only one of the failure mechanisms may have some beneficial effect, but not as much beneficial effect as when the two failure mechanisms are treated together as here.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of fabricating an article protected by a thermal barrier coating system, comprising the steps of providing an article substrate having a substrate surface; thereafter producing a flattened band coat on the substrate surface, the step of producing the flattened bond coat including the steps of depositing a bond coat on the substrate surface, the bond coat having a bond coat surface, and processing the bond coat to achieve a flattened bond coat surface having an average grain boundary displacement height of less than about 3 micrometers; and thereafter depositing a thermal barrier coating overlying the bond coat surface, the thermal barrier coating comprising yttria-stabilized zirconia having a yttria content of from about 3 percent by weight to about 5 percent by weight of the yttria-stabilized zirconia.

2. The method of claim 1, wherein the step of providing the article substrate includes the step of providing the article substrate comprising a nickel-base superalloy.

3. The method of claim 1, wherein the step of providing the article substrate includes the step of providing the article substrate comprising a component of a gas turbine engine.

4. The method of claim 1, wherein the step of depositing the bond coat includes the step of depositing a diffusion aluminide bond coat.

5. The method of claim 1, wherein the step of depositing the bond coat includes the step of depositing a platinum aluminide bond coat.

6. The method of claim 1, wherein the step of processing the bond coat includes the step of flattening the bond coat surface without removing material from the bond coat surface.

7. The method of claim 1, wherein the step of processing the bond coat includes the step of peening the bond coat.

8. The method of claim 1, wherein the step of processing the bond coat includes the step of peening the bond coat with a peening intensity of from about 6 A to about 12 A.

9. The method of claim 1, wherein the step of processing the bond coat includes the step of flattening the bond coat surface by removing material from the bond coat surface.

10. The method of claim 1, wherein the step of processing the bond coat includes the step of polishing the bond coat.

11. The method of claim 1, wherein the step of processing the bond coat includes the step of polishing the bond coat by an approach selected from the group consisting of tumbling, vibrolapping, and electropolishing.

12. The method of claim 1, wherein the steps of depositing the bond coat and processing the bond coat are performed concurrently.

13. The method of claim 1, wherein the step of processing the bond coat is performed after the step of depositing the bond coat.

14. The method of claim 1, wherein the step of processing the bond coat includes the step of producing a bond coat surface having an average grain boundary displacement height of less than about 1 micrometer.

15. The method of claim 1, wherein the step of depositing the thermal barrier coating includes the step of depositing the thermal barrier coating by physical vapor deposition.

16. The method of claim 1, wherein the step of depositing the thermal barrier coating includes the step of depositing the thermal barrier coating to have the yttria content from about 3.8 to about 4.2 percent by weight of the yttria-stabilized zirconia.

17. A method of fabricating an article protected by a thermal barrier coating system, comprising the steps of providing an nickel-base superalloy article substrate comprising a component of a gas turbine engine and having a substrate surface; thereafter depositing a platinum aluminide bond coat on the substrate surface, the bond coat having a bond coat surface; thereafter processing the bond coat to flatten the bond coat surface to have an average grain boundary displacement height of less than about 3 micrometers; and thereafter depositing a thermal barrier coating overlying the bond coat surface, the thermal barrier coating comprising yttria-stabilized zireonia having a yttria content of from about 3 percent by weight to about 5 percent by weight of the yttria-stabilized zirconia.

* * * * *